United States Patent [19]

Sherrill

[11] 4,027,702

[45] June 7, 1977

[54] LOOM REED

[75] Inventor: Frank C. Sherrill, Greensboro, N.C.

[73] Assignee: The Ellison Company, Inc., Greensboro, N.C.

[22] Filed: Apr. 21, 1976

[21] Appl. No.: 678,969

[52] U.S. Cl. ..... 139/192

[51] Int. Cl.[2] ..... D03D 49/62

[58] Field of Search ..... 139/188 R, 190, 192

[56] References Cited

UNITED STATES PATENTS

| | | | |
|---|---|---|---|
| 2,231,126 | 2/1941 | Kinsella | 139/192 |
| 3,075,560 | 1/1963 | Pfarrwaller | 139/188 |
| 3,590,880 | 7/1971 | Kathriner | 139/192 |

*Primary Examiner*—Henry S. Jaudon

[57] ABSTRACT

In a loom of the type in which a series of set screws impinge upon and grip the surface of the lower backing strip of the loom reed to hold the reed in position, distortion of the dent wires by overtightening of the set screws is prevented by means of an improved backing strip construction. The dent wires are shortened so that they extend down only partially into the space between a pair of spaced parallel side plates, each of which has an upper portion between which the lower ends of the dent wires extend and terminate, and a lower portion against which the set screws impinge. A force absorbing, spacer plate or bar is sandwiched between the lower portion of the side plates in abutting relation with the lower ends of the dent wires and absorbs the force of the set screws.

1 Claim, 4 Drawing Figures

LOOM REED

BACKGROUND OF THE INVENTION

For many years, loom reeds have been mounted on looms by means of an upper reed cap and a lower lay which receive the upper and lower backing strips respectively of the loom reed and hold the reed in the loom as it is continuously beat against the filler. In recent years, a loom known as the "Sulzer" loom has become increasingly popular. In the "Sulzer" loom, and other similar looms the reed is supported by the lay only, with no connection at all by a reed cap at the upper side along the backing strip. A plurality of set screws extend through a portion of the lay and are tightened against one surface of the lower backing strip to secure the loom reed in proper position for operation. In an 80 inch loom, there are approximately 25–30 of such set screws to be tightened.

Problems have arisen in such a mounting system leading to distortion or skewing of the dent wires in the following way. Although instructions with the loom are very precise as to the proper tightening force to be exerted by the set screws against the lower backing strip, it frequently occurs that when a loom fixer becomes hurried the screws may be overtightened to the extent that depressions in the backing strip will occur. The result of such overtightening of the set screws is that the dent wires become skewed or distorted, with the spaces therebetween becoming non-parallel which leads to attendant problems and defects in the fabric being woven.

SUMMARY OF THE PRESENT INVENTION

The present invention, on the other hand, is directed to a novel and improved construction of the lower backing strip for loom reeds in which the wire dents extend only partially into a portion (upper portion) of the space between the side plates forming the backing strip. A spacer plate abuts against the lower end of the dent wires and between the lower portions of the side plates against which the set screws impinge. Therefore, as the set screws are tightened, overtightening will not have any affect on the dent wires, as the dent wires are not located behind the points on the side plates against which the set screws are being tightened.

It is therefore a first object of the invention to provide an improved construction for loom reed backing strips used with looms of the type in which the reed is held in the lay by set screws which impinge upon and grip the surface of the lower backing strip.

It is another object of the present invention to provide an improved loom reed construction which may be securely mounted to the "Sulzer" type loom without damage thereto.

A further and more specific object of the present invention is to provide a loom reed in which the upper portion of the backing strip covers the lower end of the dent wires and a force absorbing means is positioned between the lower portion of the two side plates forming the backing strip in the area against which the set screws impinge. Other objects and a fuller understanding of the invention will become apparent from reading the following disclosure of the preferred embodiment in view of the accompanying drawings in which.

DETAILED DESCRIPTION OF THE PREFERRED EMBODIMENT

Figure 1:
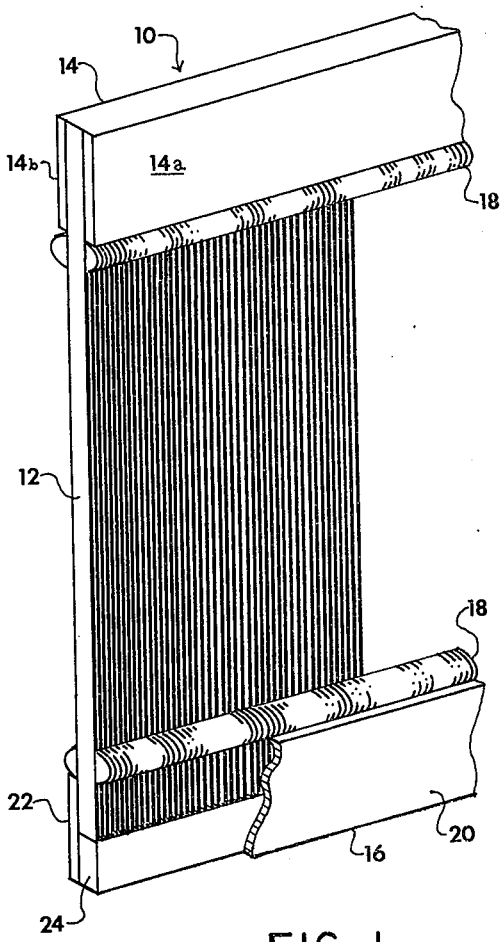
FIG. 1 is a perspective illustration, with parts broken away for the sake of clarity, illustrating the unique construction of the loom reed according to the present invention.

Turning now to the drawings, and particularly to FIG. 1, there is illustrated the improved loom reed 10 according to the present invention. A plurality of spaced, parallel dents or dent wires 12 extend vertically between an upper backing strip 14 and a lower backing strip 16. The upper backing strip 14 is formed according to conventional techniques in which a pair of side plates **14*a*, 14*b*, are secured by soldering, to the side edges of the upper extremities of dents 12. A conventional coil spring 18 is used to space the dents immediately below the upper backing strip 14 and immediately above the lower backing strip 16**.

Although the upper backing strip 14 is formed in a conventional manner, the lower backing strip 16 is a novel construction which affords a solution to the problems set forth hereinabove. First of all, the dent wires 12 extend into and are retained in the space between side plates 20, 22. Note, however, that contrary to upper backing strip 14 (conventional), the dent wires 12 extend only into the upper portion of the space between plates 20, 22. The lower space between side plates 20, 22 is filled with an excessive force absorbing means, for example such a spacer plate 24, for reasons to be described hereinafter. Solder, epoxy, or other cementitious material is introduced between the lower ends of dent wires 12 in a conventional manner prior to the application of side plates 20, 22 and spacer plate 24. The upper edge of spacer plate 24 abuts against the lower ends of dent wires 12, and the plate 24 is approximately the same thickness as the thickness of dent wires 12, so that the inner surface of the side plates 20, 22 engage both the opposite edges of the lower ends of the dent wires between the upper portions thereof and the opposite surfaces of plate 24 adjacent the lower portion thereof.

Figure 2:
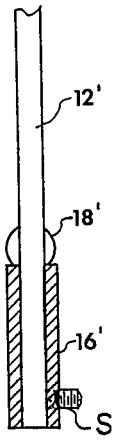
PRIOR ART FIG. 2
FIG. 2 is a partial cross-sectional view, illustrating loom reed construction according to the prior techniques.
Figure 3:
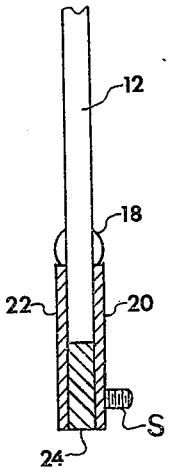
FIG. 3 is a partial cross-sectional view illustrating schematically the loom reed construction according to the present invention and showing how the previously occurring problems have been overcome.

While the construction may seem to be simple, it is a very effective solution to the problem as best illustrated in FIGS. 2 and 3. FIG. 2 is illustrative of the prior art in which, as a set screw S is tightened against the backing plate 16', if a prescribed force is exceeded, the backing plate will be depressed with the result that the dent wires therebehind may become bent, skewed, or distorted accordingly. Such distortion of the dent wires can be extremely deleterious to the quality of the fabric being processed through the loom, as it is of the utmost importance that the dent wires 12 remain absolutely straight and parallel.

Note, however, in FIG. 3 the set screw does not bear against the portion of the side plate 20 which overlaps dent wires 12. Rather, the set screws bears against the lower portion of the side plate 20, which has positioned therebehind the spacer plate 24. In this construction, if excessive force is accidentally applied to the set screw S; no damage occurs to the dent wire, because the spacer plate 24 absorbs the excessive force.

There is therefore provided an improved construction for loom reed backing strips which prevents damage thereto in the form of distortion or skewing of the dent wires as a result of excessive tightening of the mounting screws.

Figure 4:
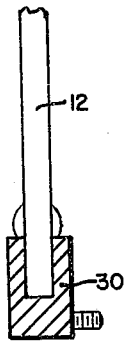
FIG. 4 is a partial cross-sectional view illustrating schematically the loom reed construction according to another embodiment of the present invention.

It should be recognized that the force absorbing means could be fabricated integrally with the side strips to form a U-shaped backing member 30 in which the set screws bear against the side of the solid base and the legs surround the lower ends of the dents (FIG. 4). Such U-shaped member could be either steel or aluminum. It is also apparent that other changes and modifications could be made to the embodiment illustrated and described hereinabove without departing from the scope of the invention. With this in mind, the invention is then to be limited only by the following claims.

What is claimed is :

1. An improved loom reed of the type having an upper and lower backing strip extending transversely in parallel relation across the width of a loom and secured in a loom by means of set screws which extend from the lay, impinge upon, and bring pressure to bear against the outer surface of the lower backing strip, said loom reed comprising:

a. a plurality of spaced, parallel dent wires extending vertically between said upper and lower transversely extending backing strips, the lower ends of said dents being secured in spaced relation by cementitious material;

b. at least the lower of said backing members comprising a U-shaped member having a pair of spaced upstanding legs intergrally formed with a vertically enthickened lower force absorbing portion;

c. said pair of spaced upstanding legs of said U-shaped member overlying and receiving the lower, cementitious material filled ends of said dent wires, and the upper surface of the lower, force absorbing portion of said U-shaped member abutting against the lower ends of said dents and the vertically enthickened portion providing a force absorbing surface against which said set screws impinge.

* * * * *